United States Patent [19]

Kinsella

[11] 4,190,903

[45] Mar. 4, 1980

[54] NECK PROTECTOR

[76] Inventor: Florence A. Kinsella, 2515 First St., Apt. 47, Ft. Myers, Fla. 33901

[21] Appl. No.: 938,868

[22] Filed: Sep. 1, 1978

[51] Int. Cl.[2] ..... A41D 27/12

[52] U.S. Cl. ..... 2/60

[58] Field of Search ..... 2/60, 232

[56] References Cited

U.S. PATENT DOCUMENTS

| | | | |
|---|---|---|---|
| 898,200 | 9/1908 | Elzas | 2/232 |
| 1,000,033 | 8/1911 | Murphy | 2/60 |
| 1,484,187 | 2/1924 | O'Neill et al. | 2/60 |

FOREIGN PATENT DOCUMENTS

| | | | |
|---|---|---|---|
| 15450 | of 1887 | United Kingdom | 2/60 |
| 27572 | of 1908 | United Kingdom | 2/60 |

*Primary Examiner*—Thomas F. Callaghan
*Assistant Examiner*—Doris L. Troutman
*Attorney, Agent, or Firm*—Samuel R. Genca

[57] ABSTRACT

A neck protector has a fluid absorbent band placeable about a neck in overlapping relationship and includes a foldable retaining means for retaining the band in the overlapping relationship. The retaining means includes at least one wire which may be bent along its longitudinal axis into a deformed state to retain the band in the overlapping relationship. The band is also foldable with the wire and defines a fold for receiving other protective sheets or capes therein. In this combination, the neck protector is adapted to conform to various neck sizes and lengths.

1 Claim, 16 Drawing Figures

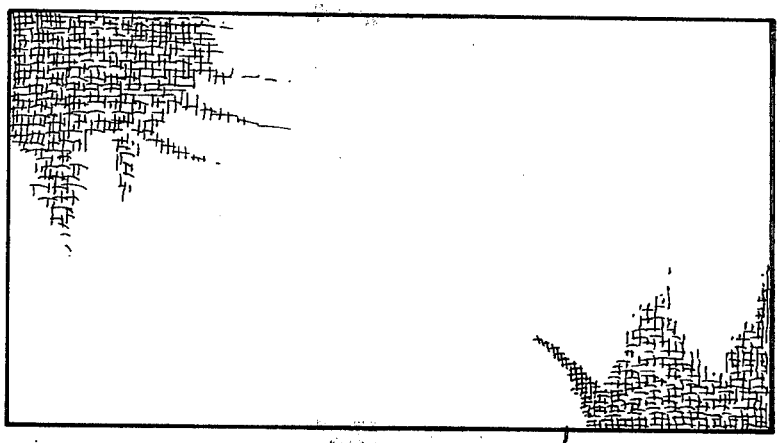
FIG. 1
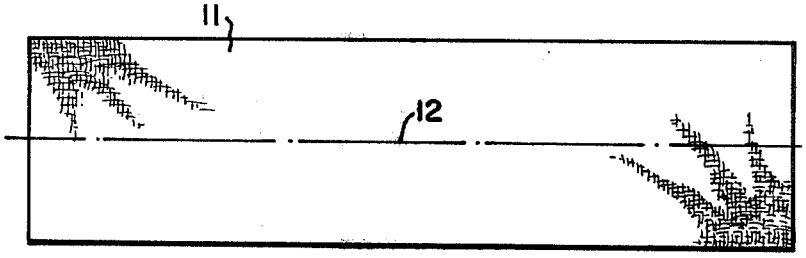
FIG. 2
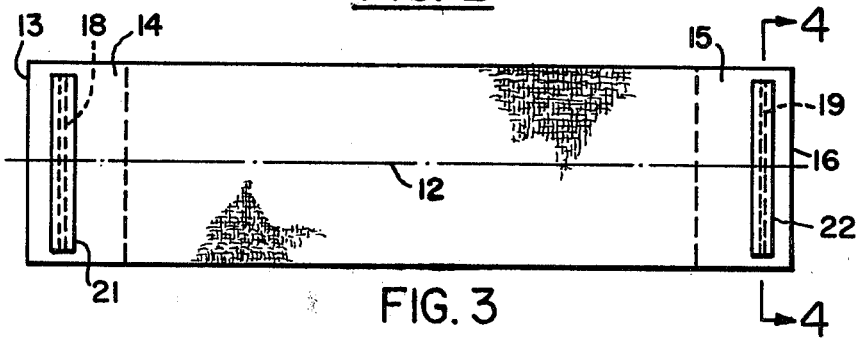
FIG. 3
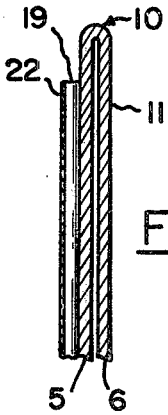
FIG. 4
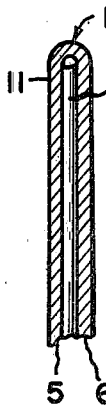
FIG. 4a
FIG. 5
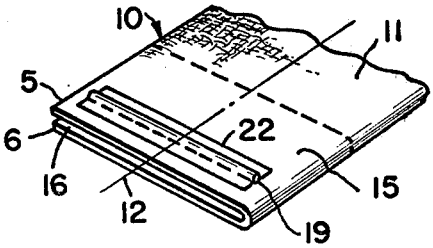
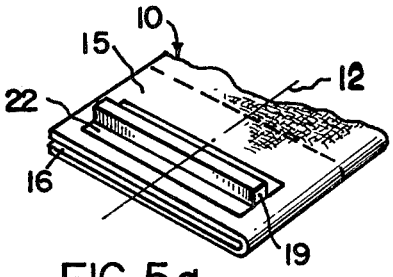
FIG. 5a
FIG. 5b
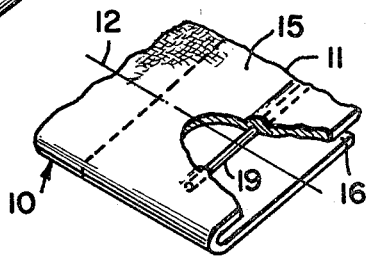

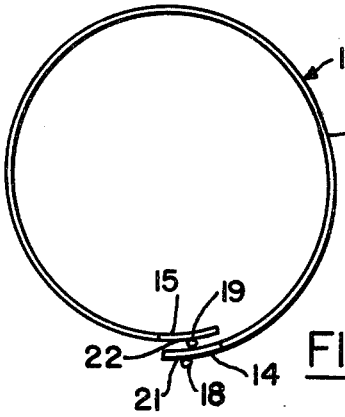
FIG. 6
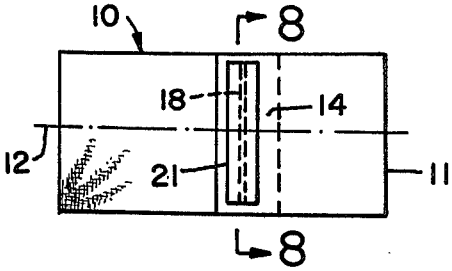
FIG. 7
FIG. 8
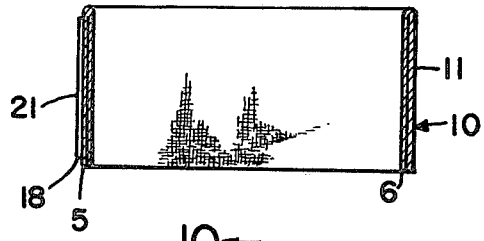
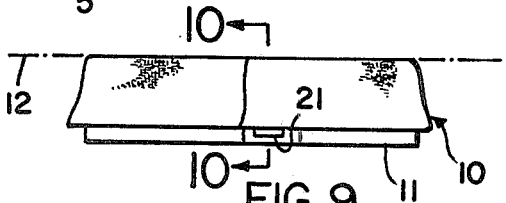
FIG. 9
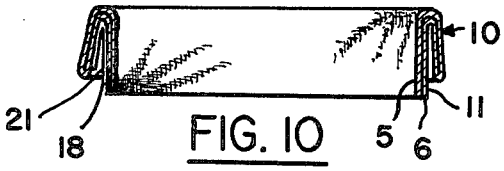
FIG. 10
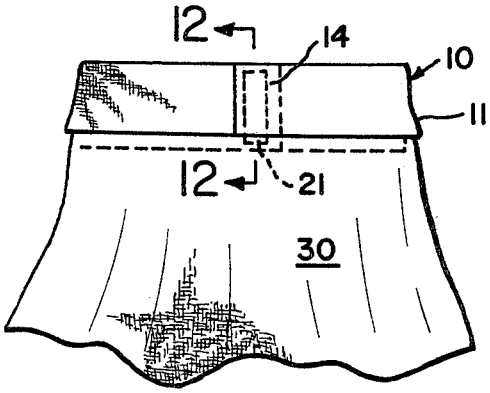
FIG. 11
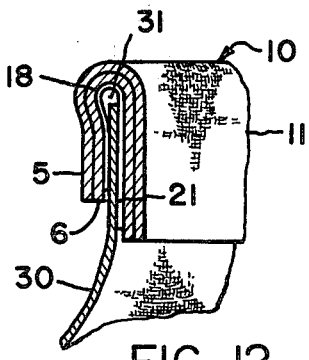
FIG. 12
FIG. 13
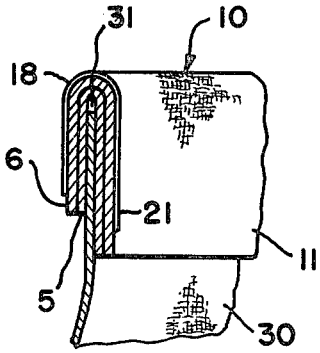

NECK PROTECTOR

BACKGROUND OF THE INVENTION

1. Field of the Invention

The present invention relates generally to sanitary disposable neck protectors and in particular to a neck protector for use by hospitals, doctors, dentists, beauticians and barbers.

2. Prior Art

Neck protectors for use in beauty parlors and barber shops are well known to those skilled in the art. Prior art neck protectors include tissue strips of pulpy substances or paper toweling between the neck and a water repellent apron that is fastened at or near the nape of the neck. The pulpy substance and paper toweling readily absorb liquids and become soggy and fall apart and therefore do not function nor do they serve the purpose for which they were intended. On the other hand, woven cloth towels must be generally fastened by safety pins around the neck and therefore the danger of jabbing the neck is prevalent. Other means of neck protectors include an adhesive coating attached to adhere to the flesh of the wearer to hold the paper in position. Such devices are neither sanitary nor comfortable in use.

Problems of long standing in the use of neck protectors of the prior art are that they quickly lose their sanitary conditions, they are uncomfortable, they fall apart with the absorption of water and are expensive to manufacture and use. Accordingly, there exists a pressing need for a neck protector which is inexpensive to manufacture, relatively easy to use and prevents water and fluids from bypassing the neck protector.

SUMMARY OF THE INVENTION

Briefly described, a neck protector in accordance with a preferred embodiment of the invention comprises a neck band of fluid absorbent material and placeable about a neck in overlapping relationship at opposite ends thereof for at least a portion of the neck. The band has a length along a longitudinal axis of the band greater than the circumference of the neck so that the neck band overlaps the neck at opposite ends thereof within a first region at one end of the band and a second region at the other end of the band. The neck band is foldable proximal and along the longitudinal axis of the band so that when the band is folded thereat, its resultant width is less than the width of the neck. At least one wire which may be bent about its own longitudinal axis into a deformed state is fixed to the band transversely to the longitudinal axis of the band at one end of the band in one of the first and second regions so that the band is retained in the overlapping relationship when the wire is deformed. The wire fixed to the band also serves as a vertical support for the neck band and also locks the band in the overlapping relationship.

BRIEF DESCRIPTION OF THE DRAWINGS

The invention will be better understood upon consideration of the following detailed description taken together with the accompanying drawing in which are elements in various figures have like designations and in which:

FIG. 1 is a plan view of a neck band;

FIG. 2 is also a plan view of the neck band of FIG. 1 in a folded position;

FIG. 3 is a plan view of the neck protector;

FIG. 4 is a sectional view of the neck protector taken along line 4—4 of FIG. 3;

FIG. 4*a* is a sectional view similar to FIG. 4 only showing a modification of the neck protector;

FIG. 5 is a fragmentary perspective view of one end of the neck protector of FIG. 3;

FIG. 5*a* is a similar view to FIG. 5 but shows a modification of the neck protector of FIG. 3;

FIG. 5*b* is a fragmentary perspective view of the neck protector as illustrated by FIG. 4*a;*

FIG. 6 is a top view of the neck protector in an overlapping relationship;

FIG. 7 is a side view of the neck protector showing in detail the overlapping relationship of the neck protector in FIG. 6;

FIG. 8 is a cross-sectional view of the neck protector taken along lines 8—8 of FIG. 7;

FIG. 9 is a side view of the neck protector in an overlapping relationship and in a folded position;

FIG. 10 is a cross-sectional view of the neck protector taken along lines 10—10 of FIG. 9;

FIG. 11 is similar to FIG. 9 of the neck protector but showing a neck protector or sheet in use therewith;

FIG. 12 is a partial sectional view of the neck protector taken along line 12—12 of FIG. 11;

FIG. 13 is another cross-sectional view of the neck protector showing a reverse folding of the neck protector.

DESCRIPTION OF THE PREFERRED EMBODIMENT

Referring to the FIGS. and in particular to FIGS. 1–6 of the drawing, a neck protector 10 in accordance with the preferred embodiment of the invention is shown. The neck protector 10 comprises a band 11 of absorbent material such as used in paper toweling or absorbent synthetic material. The preferred material for the band 11 is a kitchen cloth manufactured by Colgate-Palmolive Co. under the trademark HANDI WIPES. Such kitchen cloths may be made of rayon for example, and are quite comfortable to the neck and absorb water and other fluids without falling apart. The neck band 11 is longer than the circumference of the average adult neck taken along the longitudinal axis 12. For example, the band 11 may be in the order of twenty (20) inches so that the band 11 overlaps at opposite ends 13, 16 in first and second regions, 14, 15 respectively, as shown in FIGS. 6 and 7. The absorbency of the band 11 may be increased by the addition of plies, in which case the band 11 is preferably made about eleven (11) inches in width (FIG. 1) and then folded over in half as shown in FIGS. 2 and 3 to give a two-ply neck band 11 of approximately five and one-half (5½) inches wide. Of course, the number of plies may be increased as desired by folding again the neck band 11 as above described. The width of the band 11 may be conveniently selected to accommodate the person for whom it is intended, preferably this width may be in the order of five and one-half inches so that the band 11 may be folded again in use and operation as will be described hereinafter.

The neck protector 10 includes wires 18,19 fixed to the band 11 in regions 14,15 respectively and transversely to the longitudinal axis 12 of the band 11. In the preferred embodiment, the wires 18,19 are fixed to the band 11 by adhesive strips 21,22. The strips 21,22 and the wires 18,19 may be cemented to the band 11 by a flexible adhesive which is well known to those skilled in the art. The wires 18,19 are of a length slightly shorter than the width of the band 11 so that the wires 18,19 do not extend beyond the band 11. The strips 21,22 however, may be longer than the wires 18,19 to shield the wires 18,19. The wires 18,19 are preferably made of relatively soft wire which will take on a permanent set or deformation when bent. The wires 18,19 shown in FIGS. 3 and 5 are made of soft, round steel but in the practice of the invention, the wires 18,19 may also be made out of various cross-section wire such as flat ribbon metal or plastic (FIG. *5a*) which may easily be bent along its own longitudinal axis into a U-shape configuration.

The wires 18,19 serve as the means for retaining the band 11 around a person's neck, when the wires 18,19 are folded over with the band 11 in the regions 14,15 as shown in FIGS. 6,7. While two wires 18,19 are shown, it should be understood that one of the wires 18,19 is suitable for retaining the band 11 in place about a neck. However, it is preferred that two wires 18,19 be employed.

In the operation of the neck protector 10, the neck protector 10 is placed about a neck so that the ends 13 and 16 and the regions 14 and 15 overlap the neck band 11 as shown in FIG. 7. In this position the regions 14,15 overlap and the wires 18,19 are disposed in both regions 14,15. The wires 18, 19 are then bent along their own axis and at the same time, the band 11 is folded over as shown in FIGS. 9 and 10. FIG. 8 shows the neck protector 10 before folding. The soft wires 18,19 take on a permanent set and are in the deformed state to retain the band 11 about the neck, and thus become the foldable retaining means for retaining the neck band 11 about the neck. The band 11 and wires 18,19 may be placed either against the neck or may be separated from the neck by the neck band 11. In either case, the folding of the wires 18,19 and band 11 retains the neck protector 10 about the neck.

If desired, a protective sheet or cape 30 may be placed about the neck band 11 before the neck band 11 and wires 18,19 are folded over so that the neck band 11 may be folded over to the cape 30. FIGS. 12 and 13 show the cape 30 in a fold 31 of the neck protector 10 to hold the cape 30 therein.

Other modifications will now appear, for example, in FIGS. *4a* and *5b*, the wire 19 is cemented by flexible adhesive between the plies 5,6 of the band 11. In this configuration, one of the plies 5,6 serves as the strip for holding the wire 19 in place and also cushions the wire 19.

Having thus described several forms in which the invention may be practiced, it will be evident that other modifications and improvements might be made by one skilled in the art which would come within the scope of the annexed claims.

What is claimed as new and desired to be secured by Letters Patent of the United States is:

1. A neck protector comprising:

(a) a neck band of fluid absorbent material for placement about a neck in overlapping relationship at opposite ends thereof for at least a portion of said neck, (i) said band having a length along a longitudinal axis of said band greater than the circumference of said neck so that said neck band overlaps said neck at opposite ends thereof within a first region at one end of said band and a second region at the other end of said band, (ii) said band being foldable proximal to said longitudinal axis so that when said band is folded thereat its width is less than the length of said neck.

(b) at least one wire which may be bent along its longitudinal axis into a deformed state, and (c) adhesive means for fixing said one wire to said band transverse to said longitudinal axis of said band at one of said ends in one of said first and second regions so that said band is retained in said overlapping relationship when said wire is deformed into said deformed state.

* * * * *